US006557911B2

(12) United States Patent
Nelsen et al.

(10) Patent No.: US 6,557,911 B2
(45) Date of Patent: May 6, 2003

(54) POWER-OPEN MOTOR-VEHICLE DOOR LATCH

(75) Inventors: James Nelsen, Summit Howell, MI (US); Ramene Kongara, Nevi, MI (US); Veytek Marcola, Walled Lake, MI (US)

(73) Assignee: Kiekert AG, Heiligenhaus (DE)

( * ) Notice: Subject to any disclaimer, the term of this patent is extended or adjusted under 35 U.S.C. 154(b) by 0 days.

(21) Appl. No.: 09/767,358

(22) Filed: Jan. 23, 2001

(65) Prior Publication Data

US 2002/0096889 A1 Jul. 25, 2002

(51) Int. Cl.[7] ..... E05C 3/06
(52) U.S. Cl. ..... 292/216; 292/201; 292/DIG. 23
(58) Field of Search ..... 292/201, 216, 292/DIG. 23

(56) References Cited

U.S. PATENT DOCUMENTS 4,290,634 A * 9/1981 Gelhard ..... 292/201
4,518,181 A * 5/1985 Yamada ..... 292/201
4,624,491 A * 11/1986 Vincent ..... 185/40 R
4,904,006 A * 2/1990 Hayakawa et al. ..... 292/201
4,926,707 A * 5/1990 Yamada ..... 292/201
5,002,322 A * 3/1991 Fukumoto ..... 292/142
5,020,838 A 6/1991 Fukumoto
5,649,726 A * 7/1997 Rogers et al. ..... 292/201
5,667,263 A * 9/1997 Kleefeldt et al. ..... 292/201
5,802,894 A * 9/1998 Jahrsetz et al. ..... 292/144
6,003,910 A * 12/1999 Dupont et al. ..... 292/201

* cited by examiner

*Primary Examiner*—J. J. Swann
*Assistant Examiner*—Thomas Ho
(74) *Attorney, Agent, or Firm*—Herbert Dubno; Andrew Wilford

(57) ABSTRACT

A motor-vehicle door latch has a housing, a fork pivotal on the housing between a bolt-retaining latched position and a bolt-releasing unlatched position, and a pawl pivotal on the housing between a holding position engaging the fork and retaining it in the latched position and a freeing position allowing the fork to move into the unlatched position. A wheel rotatable about an axis has a radially directed cam surface on which rides a projection on the pawl. A drive motor can rotate the wheel and thereby engage the surface with the projection to displace the pawl into its freeing position. A spring is braced between the pawl and the housing and urges the pawl into the holding position and the projection into engagement with the surface. Furthermore the wheel has a groove having a pair of ends, one radially directed flank formed by the cam surface, and an opposite radially directed flank forming another surface. The cam surface is formed as a spiral generally centered on the wheel axis and the other surface is generally centered on the wheel axis. The groove has a wide end and a narrow end.

10 Claims, 3 Drawing Sheets

POWER-OPEN MOTOR-VEHICLE DOOR LATCH

FIELD OF THE INVENTION

The present invention relates to a motor-vehicle door latch. More particularly this invention concerns such a latch which has a remotely controlled motor that can open it.

BACKGROUND OF THE INVENTION

A motor-vehicle door latch of the type used on a trunk lid has a housing normally mounted on the door and carrying a pivotal fork that can engage in a latched position around a door bolt carried on a door edge or door post and that can, in an unlatched position, allow the door bolt to move out of the latch. Of course the fork could be carried on the vehicle body and the bolt on the door to the same effect. A pawl is pivotal on the latch housing between a position engaging the fork and holding it in the latched position and a freeing position allowing the fork to move into the unlatched position. Respective fork and pawl springs normally urge the fork into the unlatched position and the pawl into the holding position.

As described in U.S. Pat. No. 5,020,838 of Fukumoto such a latch can have a small electric motor with a rotary output carrying a worm meshing with external teeth on an operating wheel in turn carrying a pusher element engageable with the pawl to move it into its freeing position. A separate mechanical linkage connects the pawl to a lever in the vehicle so that, if the motor fails, for instance when the electric power is lost, the latch can be operated manually.

This arrangement is fairly bulky and complex. In particular its overall depth is considerable so that it cannot readily be incorporated in a trunk lid which offers much less room than a vehicle passenger door. The complex and bulky structure is also somewhat expensive to manufacture, adding to the cost of the latch.

OBJECTS OF THE INVENTION

It is therefore an object of the present invention to provide an improved power-open motor-vehicle door latch.

Another object is the provision of such an improved power-open motor-vehicle door latch which overcomes the above-given disadvantages, that is which is of simple and compact construction, yet which allows for remote power actuation and remote manual actuation of the latch.

SUMMARY OF THE INVENTION

A motor-vehicle door latch has a housing, a fork pivotal on the housing between a bolt-retaining latched position and a bolt-releasing unlatched position, and a pawl pivotal on the housing between a holding position engaging the fork and retaining it in the latched position and a freeing position allowing the fork to move into the unlatched position. According to the invention a wheel rotatable about an axis has a radially directed cam surface on which rides a projection on the pawl. A drive motor can rotate the wheel and thereby engage the surface with the projection to displace the pawl into its freeing position. A spring is braced between the pawl and the housing and urges the pawl into the holding position and the projection into engagement with the surface. Furthermore the wheel has a groove having a pair of ends, one radially directed flank formed by the cam surface and an opposite radially directed flank forming another surface. The cam surface is formed as a spiral generally centered on the wheel axis and the other surface is generally centered on the wheel axis. The groove has a wide end and a narrow end.

The use of a cam rather than a pusher element allows the system to be made very compact, and allows a small-torque motor to bring to bear the considerable force necessary to trip the pawl into its freeing position. In fact the structure can easily be designed using a transverse drive motor operating the wheel by means of a worm gear so as to be quite small.

The cam surface according to the invention is inward of the other surface so that the projection is cammed radially outward on movement from the holding to the freeing position by the wheel. In addition a manual-actuation lever is coupled to the pawl for pivoting same from the holding to the freeing position when the projection is at the wide groove end. The pawl has a pivot and the lever is coaxially pivoted with the pawl and has an end coupled to the pawl at the projection. Thus the latch can be opened manually in case the motor or its power supply fails.

The projection according to the invention has a dimension measured radially of the wheel which is slightly smaller than a radial dimension of the groove at the narrow end. Normally it is formed as a cylindrical pin that extends parallel to the wheel axis.

In accordance with the invention a spring urges the wheel into a position with the projection engaging in the wide groove end. It does so with enough force to overcome the drive, so long as it is not energized, so that the spring will return the latch to a position in which it can be manually opened if power fails at any time. This spring is a spiral spring connected between the housing and a shaft of the wheel.

The wheel shaft has a slotted end so that a tool can be fitted to the slotted end to manually rotate the wheel. In addition a rubber bumper is provided on the housing engaging the fork in the unlatched position.

BRIEF DESCRIPTION OF THE DRAWING

The above and other objects, features, and advantages will become more readily apparent from the following description, reference being made to the accompanying drawing in which.

SPECIFIC DESCRIPTION

Figure 6:
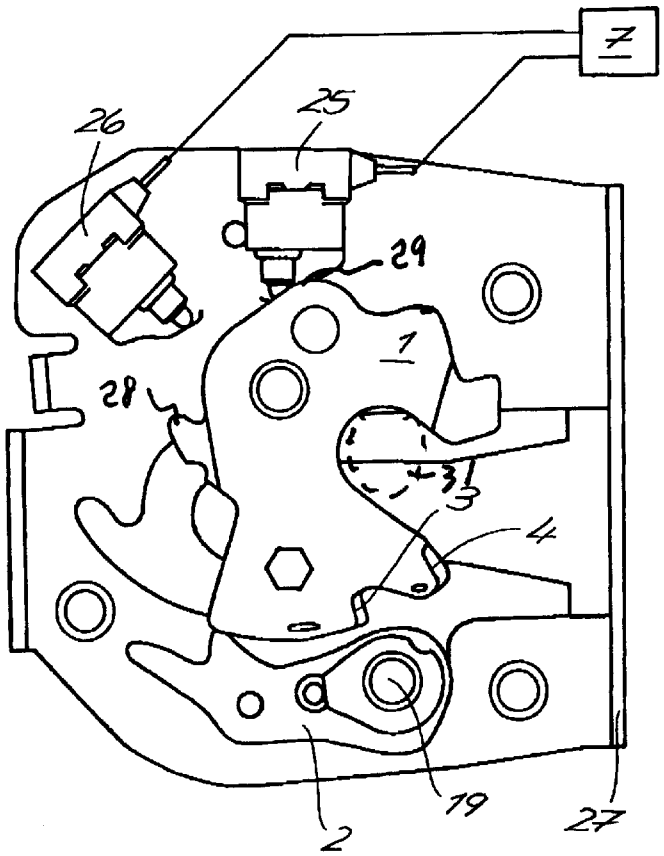
FIG. 6 is a partly diagrammatic side view of the latch in accordance with the invention in the unlatched or open position.

As seen in the drawing a motor-vehicle door latch has a housing 27 (FIG. 6 only) in which a standard rubber-edged latch fork 1 is pivotal about an axis 32 adjacent a standard latch pawl 2 pivotal on a pin 19 about an axis 30 and engageable with either of two steps 3 and 4 on the fork 1 to hold it in a partially closed or fully closed position, respectively. The fork 1 and latch pawl 2 are shown in the respective latched and holding positions in FIGS. 3 and 4 and in the respective unlatched and freeing positions in FIGS. 5 and 6. Respective torque springs 22 and 23 urge the pawl 2 into the holding position and the fork 1 into the unlatched position. In the unlatch position the fork 1 engages an a rubber bumper 24 of the housing 27 and frees a bolt shown schematically at 31 (FIGS. 5 and 6). This structure is generally standard.

According to the invention a drive 5 serving to displace the pawl 2 between the holding and freeing positions is comprised of a reversible electric motor 5*a* carrying a worm 5*b* meshing with external teeth 5*c* on an operating wheel 6 centered on an axis 11. The axis 5*d* of the worm 5*b* lies in a plane perpendicular to the coaxial axes 11, 30, and 32 of the wheel 6, pawl 2, and fork 1. The wheel 6 is fixed on a shaft 10 having an end slot 9 and connected to the inner end of a large torque spring 8 whose outer end is fixable on an abutment 12 of the housing 27 so as to urge the wheel 6 in a direction (counterclockwise in FIGS. 3 through 6) to allow the pawl 2 to be moved by its spring 22 into its latching position. The drive 5 is of the nonlocking type and the spring 8 is fairly strong so that, if the motor 5*a* is not energized, the spring 8 has the strength to reverse rotate the wheel 6 counterclockwise into the position of FIG. 3. The slot 9 also makes it possible for a screwdriver to be fitted to the shaft 10 to manually rotate the wheel 6.

The face of the wheel 6 opposite the spring 8 is formed with a cam groove 18 defined between an inner surface 15, an outer surface 17, and a pair of end-abutment surfaces 14*a* and 14*b*. The outer surface 17 is generally circular and centered on the wheel axis 11 and the inner surface is formed as a spiral having an inner end closes to the axis at the face 14*a* and an outer end furthest from the axis at the face 14*b*. The groove 18 thus has a wide radial dimension $S_1$ (FIG. 3) at the end face 14*a* and a narrow width $S_2$ (FIG. 5) at the end face 14*b*.

In addition the pawl 2 is provided with an entrainment formation constituted as a cylindrical pin 13 extending parallel to the pawl axis 30 and having an outer end engaged in the groove 18. This entrainment pin 13 has a diameter equal to slightly less than the dimension $S_2$ and a small fraction of the dimension $S_1$ so that, when against or near the wide-end surface 14*a* the pin 13 and pawl 2 can pivot a s shown in FIG. 3 by arrow D between the holding and freeing positions. When the pin 13 is against or near the narrow-end surface 14*b*, that is in the narrow end of the groove, the latch paws 2 is retained in the freeing position and cannot move into the holding position. The pin 13 prevents the wheel 6 from rotating through more than a single revolution since the surfaces 14*a* and 14*b* are formed on opposite faces of a radially extending web.

In addition according to the invention a lever 20 pivoted on the pin 19 at the axis 30 has a forked rear end 21 through which extends the pin 13 so that this lever 20 is coupled to the pawl 2 for joint pivoting therewith about the axis 30. The other end of this lever 20 is coupled via a bowden cable illustrated schematically at 33 to a lever shown at 16 for manual actuation of the latch. Bumps 28 and 29 on the fork 1 can cooperate with respective switches 25 and 26 to report to a controller 7 whether the latch is in the open (neither switch actuated), partially closed (switch 26 actuated), or fully closed (switch 27 actuated) position.

Figure 3:
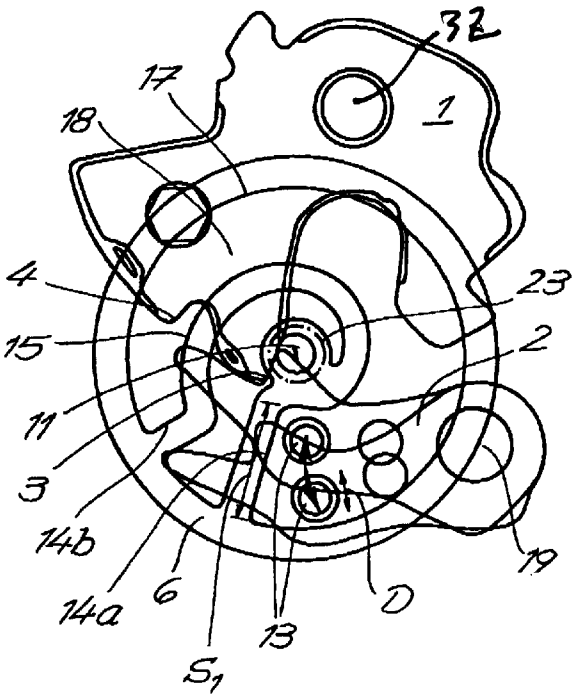

The latch operates as follows:

Under normal conditions with the motor 5*a* deenergized and the vehicle door closed, the bolt 31 (FIGS. 5 and 6) is held by the fork 1 which is retained in the latched position by the pawl 2 as shown in FIG. 3. The pin 13 is close to or against the surface 14*a*. In this position it is possible by actuation of the lever 16 to pivot the pawl 2 and move it radially outward in the wide end of the groove 18 so as to manually open the latch.

Figure 2:
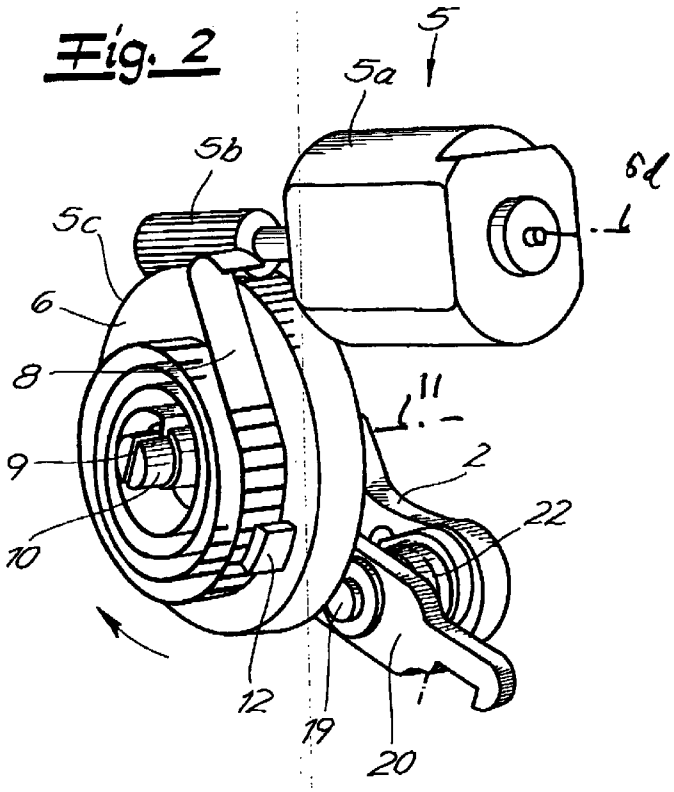
FIGS. 1 and 2 are perspective views illustrating the basic elements of the latch according to the invention.
Figure 1:
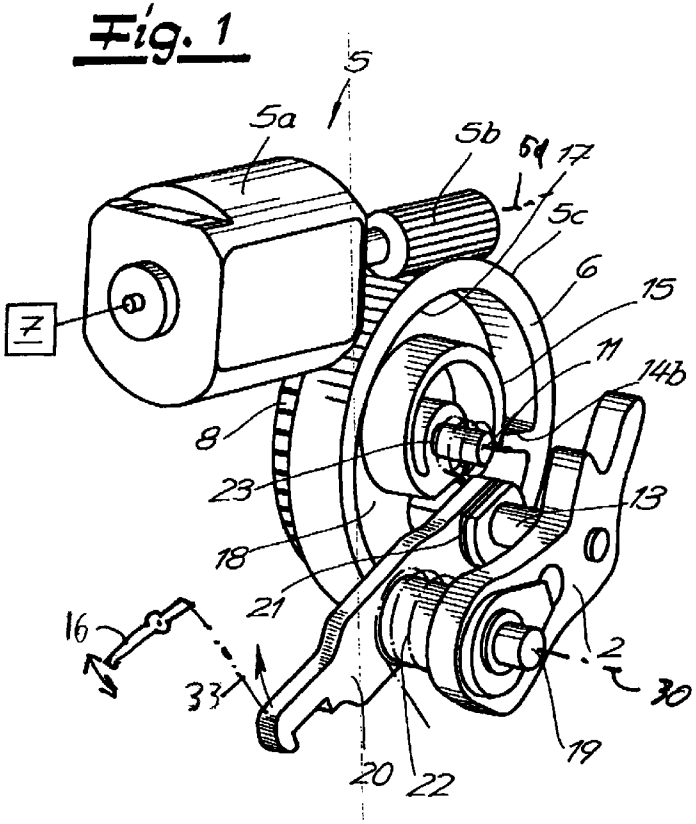
Figure 4:
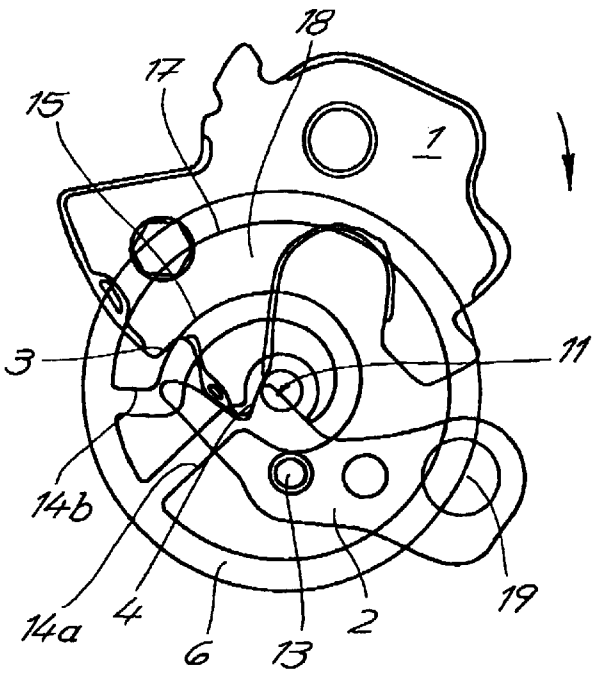
FIGS. 3 and 4 are mainly diagrammatic views of the inventive latch in the latched or closed position.
Figure 5:
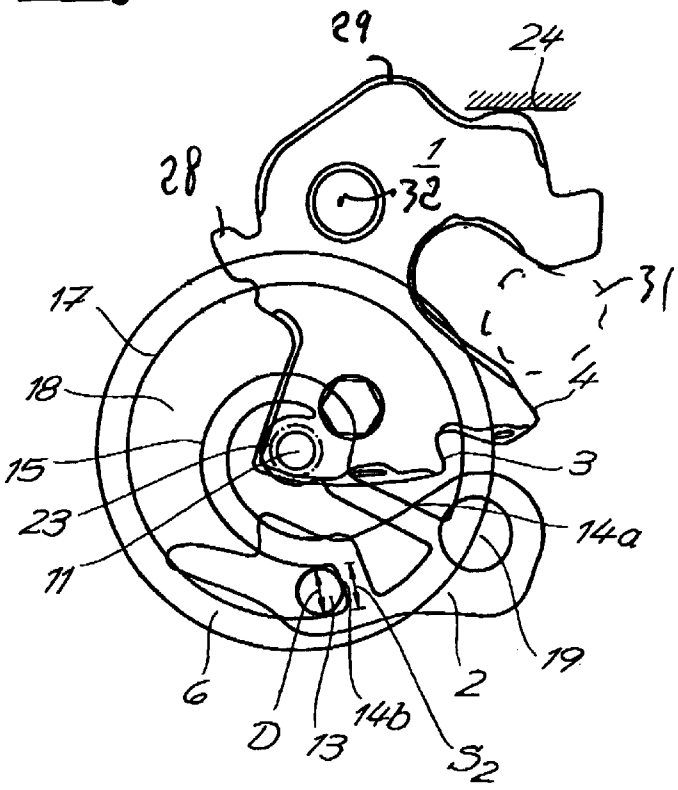
FIG. 5 is a view like FIG. 4 of the latch in the unlatched or open position.

The latch is opened by energization of the motor 5*a* from the controller 7 to rotate the wheel 6 clockwise as shown in FIGS. 2 through 6. This causes the pin 13 to be cammed radially outward as shown in FIG. 4 by the outward-spiraling inner cam surface 15 of the slot 18 until the pawl 2 disengages from the fork 1, allowing it to pivot out as shown in FIGS. 5 and 6.

Once the latch is opened, the controller 7 deenergizes the motor 5*a* and the spring 8 returns the wheel 6 to the FIG. 3 starting position. The pawl 2 will move in and, when the latch is closed and the fork 1 is pivoted back inward, the pawl 2 will engage and hold the fork 1.

The entire mechanism can be made quite flat measured parallel to the axes 11, 30 and 32. Thus it can easily be accommodated in a trunk lid. In addition the compact interfit of the parts, with the lever 20 between the pawl 2 and the heel 2, makes the latch quite rugged.

What is claimed is:

1. A motor-vehicle door latch comprising:

a housing;

a fork pivotal on the housing between a bolt-retaining latched position and a bolt-releasing unlatched position;

a pawl pivotal on the housing between a holding position engaging the fork and retaining it in the latched position and a freeing position allowing the fork to move into the unlatched position;

a wheel rotatable about an axis, having a shaft with a slotted end, and formed with a groove having a wide end, a narrow end angularly spaced from the wide end, a radially directed spiral cam surface centered on the axis and extending angularly between the ends, and another surface centered on the axis, radially confronting the spiral cam surface, and extending angularly between the ends;

a projection on the pawl riding in the groove on the spiral cam surface and engageable angularly against the groove ends;

spring means including a spiral spring connected between the housing and the slotted shaft end for urging the wheel into a position with the projection bearing against the wide groove end; and means including a drive motor for rotating the wheel and thereby engaging the spiral cam surface with the projection to displace the pawl into its freeing position bearing against the narrow groove end, the ends being dimensioned such that when the projection is engaged in the wide end the pawl can move between the holding and freeing positions but when the projection is in the narrow end the pawl is retained in the freeing position.

2.The motor-vehicle door latch defined in claim 1, further comprising a spring braced between the pawl and the housing and urging the pawl into the holding position and the projection into engagement with the spiral cam surface.

3. The motor-vehicle door latch defined in claim 2 wherein the spiral cam surface is inward of the other surface, whereby the projection is cammed radially outward on movement from the holding position to the freeing position by the wheel.

4. The motor-vehicle door latch defined in claim 2, further comprising means including a manual-actuation lever coupled to the pawl for pivoting same from the holding position to the freeing position when the projection is at the wide groove end.

5. The motor-vehicle door latch defined in claim 4 wherein the pawl has a pivot and the lever is coaxially pivoted with the pawl and has an end coupled to the pawl at the projection.

6. The motor-vehicle door latch defined in claim 2 wherein the projection has a dimension measured radially of the wheel which is slightly smaller than a radial dimension of the groove at the narrow end.

7. The motor-vehicle door latch defined in claim 2 wherein the projection extends parallel to the wheel axis.

8. The motor-vehicle door latch defined in claim 1 wherein the wheel has external teeth, the drive means including a worm gear mounted on the motor and meshing with the wheel teeth.

9. The motor-vehicle door latch defined in claim 1, further comprising a rubber bumper on the housing engaging the fork in the unlatched position.

10. The motor-vehicle door latch defined in claim 1 wherein the surfaces diverge uniformly from the narrow end to the wide end.

* * * * *